United States Patent [19]

Zaitz

[11] 4,406,063

[45] Sep. 27, 1983

[54] PINKING SHEARS

[75] Inventor: Allen J. Zaitz, Wausau, Wis.

[73] Assignee: Oy Fiskars AB, Helsinki, Finland

[21] Appl. No.: 330,155

[22] Filed: Dec. 14, 1981

[51] Int. Cl.[3] ..... B26B 13/10

[52] U.S. Cl. ..... 30/230; 30/267; 76/104 A

[58] Field of Search ..... 30/230, 229, 267, 266; 76/104 A

[56] References Cited

U.S. PATENT DOCUMENTS

| | | | |
|---|---|---|---|
| 2,564,251 | 8/1951 | Angelis | 30/230 |
| 2,578,616 | 12/1951 | Wallace | 30/230 |
| 2,676,402 | 4/1954 | Shaler | 30/230 |
| 2,685,735 | 8/1954 | Sorensen | 76/104 A |
| 2,776,482 | 1/1957 | Hafekost | 30/230 |
| 3,678,580 | 7/1972 | Duffy | 30/267 |

FOREIGN PATENT DOCUMENTS

| | | | |
|---|---|---|---|
| 592897 | 2/1934 | Fed. Rep. of Germany | 30/230 |
| 610297 | 3/1935 | Fed. Rep. of Germany | 30/230 |

*Primary Examiner*—Jimmy C. Peters

*Attorney, Agent, or Firm*—James E. Nilles

[57] ABSTRACT

A pinking shears having a pair of blades pivotally connected together by a bolt and having cooperative teeth formed along their leading edges and having handles at the ends of the blades opposite said teeth. A non-metallic spacer and pressure producing ridge member is located between the blades and has an apertured spacer portion through which the bolt extends and which serves to provide rough blade separation. The member also has a pressure producing ridge located at the handle side of said bolt and for bearing against the blades to produce cutting pressure between the teeth of the blades. The blades have tapered leads which cooperate with one another as the shears are closed to provide gradual smooth engagement of the blades. Each of the blades also has an alignment land located outwardly in respect to the bolt and the tapered leads, the alignment lands abutting against one another when the shears are closed and the opposed teeth are brought into initial contact with one another to provide exact positioning of the blades and ensuring smooth engagement of the teeth with one another. One of the teeth of one of the blades located nearest the bolt has a cut-away relief portion to provide smooth engagement of the teeth.

10 Claims, 10 Drawing Figures

PINKING SHEARS

BACKGROUND OF THE INVENTION

This invention relates to pinking shears of the type having integral flanges projecting transversely from the insides of the blades along their leading edges and in which flanges the pinking teeth are formed so that the shearing edges of the teeth of one blade mesh with and pass through the shearing edges of the teeth of the other blade as the blades are closed.

In prior art shears of this character, various proposals have been made for ensuring that the blades properly coact with one another throughout the length of their cutting stroke, and this is usually accomplished by providing coacting raised portions at the handle side of the pivot. For example, the German Patent 592897 of Feb. 17, 1934 provides opposed, bevelled edges to ensure the proper cutting action. However, it does not provide for precise meshing of the teeth during their initial engagement and a spring around the pivot post provides the pressure between the opposed teeth. The German Pat. No. 610297 of Mar. 7, 1935 utilizes a flat leaf spring to provide cutting pressure between the opposed teeth but no provision is made for ensuring proper mesh of the teeth particularly during the initial engagement of the teeth.

U.S. Pat. No. 2,578,616 of Dec. 11, 1951 uses a resilient body such as a rubber type pad to provide the cutting force between the teeth. There is no provision for ensuring precise alignment of the teeth themselves, particularly during the initial cutting action.

SUMMARY OF THE INVENTION

The present invention provides a pinking shears having a non-metallic spacer and integral pressure producing ridge member located between the blades. The member has a spacer portion located between and at the pivot point of the blades, which provides for rough blade separation. The member also has a pressure applying ridge located at the handle side of the pivot point of the blades and which provides the proper amount of force between the blades to keep the blades in proper contact with one another throughout the cutting stroke of the shears.

The invention thus provides a simple molded part for both rough blade separation and for producing cutting pressure throughout the cutting action of the blades. The molded member provides a lubricating wear surface and the size and shape of the ridge also optimizes the amount of blade bearing surface to thereby minimize drag in the scissors action.

Another important aspect of the invention relates to a tapered lead between parts of the cooperating blades and which lead is located at the blade side of the pivot point and just ahead of an aligning land portion of the blades, which lands provide precise blade separation and eliminates the need for precise alignment at the pivot point. This tapered lead-alignment land arrangement can be produced without adding significantly to manufacturing costs and can be produced with the same process which is used to machine the cutting teeth themselves.

The non-metallic spacer and ridge member cooperates precisely with the tapered lead-alignment land configuration of the blades to provide precise alignment or separation between the blades to ensure proper initial engagement of the cutting teeth, provides proper contact between the blades throughout the length of cut, provides an opposing angle in the assembly which results in proper tension at the cutting surface and accommodates dimensional variances that would otherwise effect blade action. Thus pressure producing ridge which is integral with the blade spacer, together with the tapered lead-alignment land configuration provides a lead-in tooth design which ensures alignment, prevents blade mis-match and binding as the first tooth is engaged.

These and other objects and advantages of the present invention will appear hereinafter as this disclosure progresses, reference being had to the accompanying drawings.

DESCRIPTION OF A PREFERRED EMBODIMENT

Figure 1:
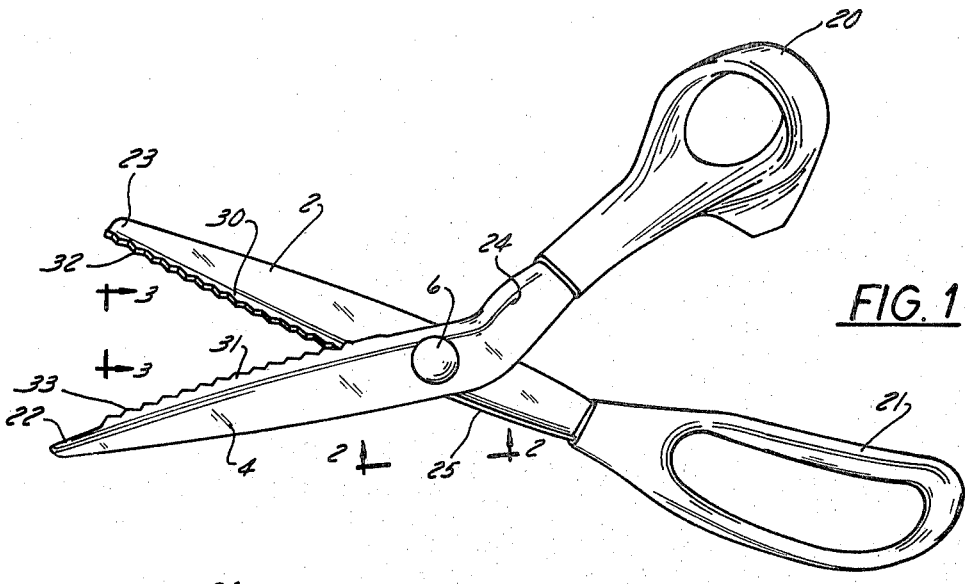
FIG. 1 is a side view of a pinking shears embodying the present invention.
Figure 3:
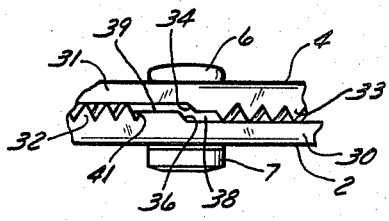
FIG. 3 is a view taken generally from the line 3—3 in FIG. 1 and showing the alignment-lands of the two blades as they are about to engage one another.
Figure 5:
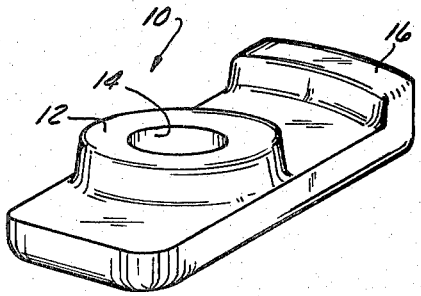
FIG. 5 is a perspective view of the non-metallic spacer and pressure producing ridge member which is shown in FIG. 2.
Figure 4:
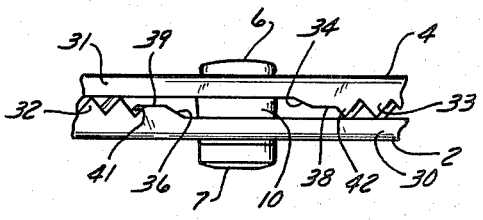
FIG. 4 is a view similar to FIG. 3 but showing the blades when moved to a more open position.

The shears shown in FIG. 1 includes a straight blade 2 and a curved blade 4 which are pivotally connected together by a bolt 6 and a nut 7 threadably engaged on the bolt, the bolt passing through aligned holes in the blades. A non-metallic washer 8 is interposed between the nut and the straight blade and serves as a non-metallic wear surface between the nut and the straight blade.

Located between the blades and on the bolt 6 is a non-metallic spacer and pressure producing ridge member 10 which is formed preferably of plastic, such as nylon, and includes a raised or spacer portion 12 having a hole 14 therethrough and through which the bolt 6 passes. The spacer portion 12 provides rough blade separation when the scissors are in the full open position, that is when there is no blade-to-blade contact. The member 10 also includes a raised ridge 16 located at its outer or handle end and this ridge serves to exert an opposing force between the blades to create proper blade tension and it also serves as a non-metallic wear surface. The ridge 16 may be of a slightly greater height than the raised spacer portion 12, for example, 0.002 inches, to ensure good contact between the teeth of the blades as the shears performs its cutting stroke.

The bent blade and the straight blade have the conventional handles 20, 21, respectively, tip ends 22 and 23, respectively, and base ends 24 and 25, respectively. The blades shown for the purpose of illustrating this invention are formed by having transversely projecting, integral flanges 30, 31 on the blades 2 and 4, respectively.

The flanges are located along the leading edges of their blades and having pinking teeth 32 and 33 formed therein so that the shearing edges of the teeth of one blade mesh and pass through the shearing edges of the teeth of the other blade as the blades are closed. Formed along the transverse flanges of the blades 2 and 4 are tapered leads 34 and 36, respectively, and which taper toward one another to provide smooth, gradual engagement of the opposing blades as the scissors are closed from full open towards the closed position. The transverse flanges also have opposed alignment lands 38 and 39 located at the outer ends of their respective tapered leads and just prior to the opposing teeth of the blades. These alignment lands are positioned at the centerline of the cutting teeth and when the lands are in engagement with one another, provide exact positioning of the blades in their opposing directions to prevent mis-alignment or cogging as the first teeth are engaged with one another. Exact positioning of the alignment lands and consequently of the blades is accomplished by lapping, and this lapping is done in conjunction with the cutting teeth lapping.

Figure 2:
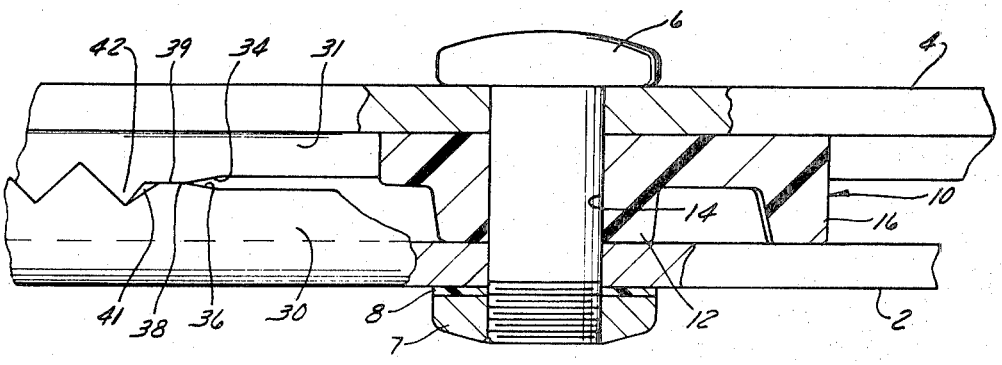
FIG. 2 is a view taken along line 2—2 of FIG. 1, but on an enlarged scale and a portion of the view being shown in cross-section.
Figure 6:
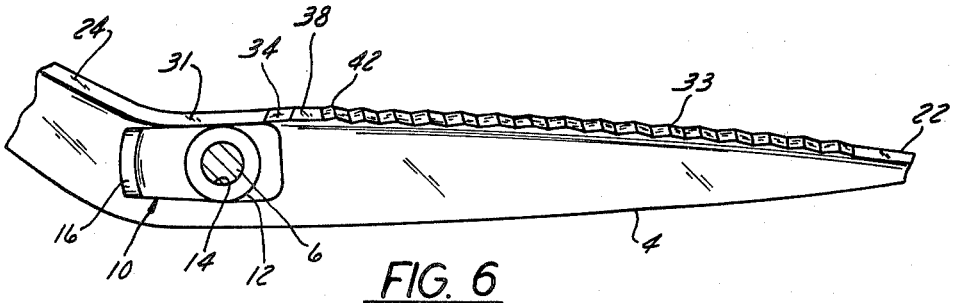
FIG. 6 is a view of the bent blade portion of the shears, the view being taken from the inner side of the blade and showing the spacer and pressure producing ridge member attached thereto.
Figure 7:
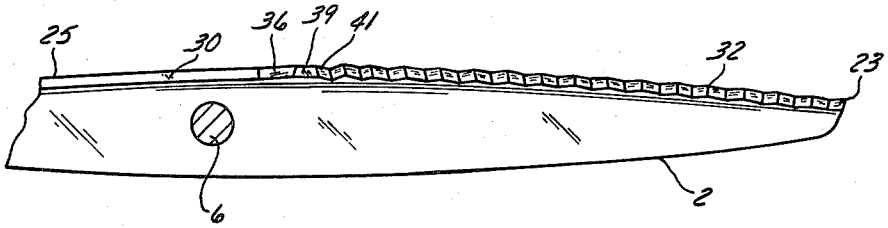
FIG. 7 is a view of the straight blade of the shears, taken from the inside thereof.
Figure 8:
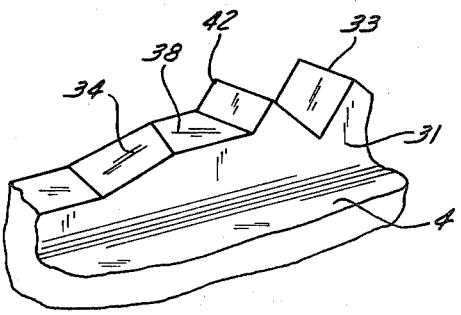
FIG. 8 is an enlarged, fragmentary view of a portion of the flange of the curved blade and showing the tapered lead and also showing the alignment land.
Figure 9:
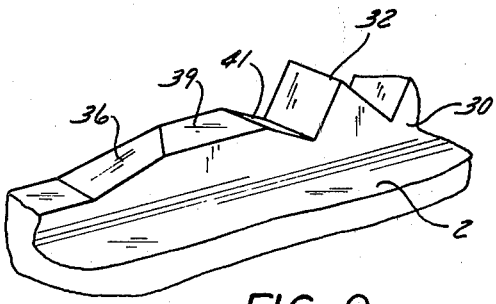
FIG. 9 is an enlarged, fragmentary view of a portion of the straight blade and showing its flange containing the tapered lead and the alignment land, and furthermore showing the cut away portion of the first tooth which forms the relief portion.
Figure 10:
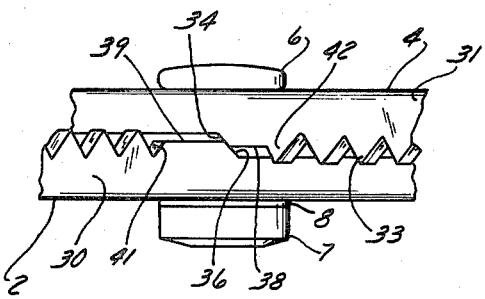
FIG. 10 is a view similar to FIGS. 3 and 4, but enlarged, and showing the blades when moved together where their tapered leads abut one another.

As shown in FIG. 2, a first tooth relief 41 is formed in the first cutting tooth 42 so as to provide smooth engagement in the mating direction and thereby preventing binding as the first tooth is engaged. Thus, the lead-in tooth design including the tapered lead and the alignment lands guarantees alignment of the teeth and prevents the blades from mis-matching and subsequent binding.

The pressure producing ridge member 16 acts to create the necessary force between the blades, and between the tapered leads and the alignment lands of the blades as the scissors are moved from an open to a closed position. When the scissors are open, however, the pressure producing ridge member 16 is inoperative, instead the spacer portion 12 acts to provide rough blade separation. The non-metallic member 10 is economical to manufacture, is very effective in performing the functions for which it was designed, and cooperates with the tapered lead and alignment lands of the blades which are located at the opposite side of the shears pivot point to produce smooth and accurate operation of the shears. Furthermore the pressure producing ridge 16 acts to maintain the opposing teeth in good shearing contact with one another throughout the length of cut of the shears. The tapered lead and alignment lands of the blades provides precise blade separation, are produced at no significant additional manufacturing costs, and are produced by the same manufacturing process that is used to machine the cutting teeth. The single molded member 10 provides for rough blade separation and eliminates the need for precise separation at the pivot point, and is incorporated with the pressure producing ridge in a single part, all of which optimize the amount of blade bearing surface to minimize drag in the scissors action. The elimination of metal-to-metal contact on the wear surface significantly increases the life of the shears.

I claim:

1. A pinking shears having a pair of blades pivotally connected together by a bolt means, said blades having cooperative teeth formed along their leading edges, said blades having handles at their ends opposite said teeth, a non-metallic spacer and pressure producing ridge member located between the blades, said member having an apertured spacer portion through which said bolt means extends and which serves to provide rough blade separation, said member also having a pressure producing ridge located at the handle side of said bolt means and for bearing against said blades to produce cutting pressure between the teeth of said blades.

2. The shears set forth in claim 1 further characterized in that said blades at the side of said bolt means opposite from said pressure producing ridge have tapered leads which cooperate with one another as said shears are closed to provide gradual smooth engagement of the blades, each of said blades also having an alignment land located outwardly in respect to said bolt means and the tapered leads, said alignment lands abutting against one another when said shears are closed and said opposed teeth are brought into initial contact with one another, said alignment-lands providing exact positioning of the blades to ensure smooth engagement of said teeth with one another.

3. The shears set forth in claim 1 further characterized in that said pressure producing ridge is of a greater height than said spacer portion.

4. The shears set forth in claim 2 further characterized in that said pressure producing ridge is of a greater height than said spacer portion whereby said spacer portion provides rough blade separation in the shears open position, and said ridge urges said alignment lands into tight abutting relationship to provide exact positioning of said blades relative to one another and ensure smooth engagement of said teeth.

5. The shears set forth in claim 1 further characterized in that the first tooth of one of said blades which is located nearest the bolt means has a cut-away relief portion to provide smooth engagement of the blade teeth.

6. The shears set forth in claim 2 further characterized in that the first tooth of one of said blades which is located nearest the bolt means has a cut-away relief portion to provide smooth engagement of the blade teeth.

7. A pinking shears having a pair of blades pivotally connected together by a bolt means, said blades having integral flanges projecting transversely from the inner side of the blades, said flanges having cooperative teeth formed along their outer edges, said blades having handles at their ends opposite said teeth, said flanges also having tapered leads which cooperate with one another as said shears are closed to provide gradual smooth engagement of the blades, each of said flanges also having an alignment land located outwardly in respect to said bolt means and tapered leads, said alignment lands abutting against one another when said shears are moved towards the closed position to thereby provide exact positioning of the blades to ensure smooth engagement of said teeth with one another.

8. The shears set forth in claim 7 including a non-metallic spacer and pressure producing ridge member located between said blades, said member having an apertured spacer portion through which said bolt means extends and which serves to provide rough blade separation, said member also having a pressure producing ridge located at the handle side of said bolt means and for bearing against said blades to urge said alignment land into abutting relationship with one another and to produce cutting pressure between the teeth of said blades.

9. A pinking shears having a pair of blades pivotally connected together by a bolt means, said blades having cooperative teeth formed along their leading edges, said blades having handles at their ends opposite said teeth, said blades having tapered leads which cooperate with one another as said shears are closed to provide gradual smooth engagement of the blades, each of said blades also having an alignment land located outwardly in respect to said bolt means and the tapered leads, said alignment lands abutting against one another when said shears are closed and said opposed teeth are brought into initial contact with one another, said alignment lands providing exact positioning of the blades to ensure smooth engagement of said teeth with one another.

10. The shears described in claim 9 including a nonmetallic spacer and pressure producing ridge member located between the blades, said member having an apertured spacer portion through which said bolt means extends and which serves to provide rough blade separation, said member also having a pressure producing ridge located at the handle side of said bolt means and for bearing against said blades to produce cutting pressure between the teeth of said blades.

* * * * *